United States Patent [19]

Shibata et al.

[11] Patent Number: 5,066,633

[45] Date of Patent: Nov. 19, 1991

[54] SENSITIZER FOR HEAT SENSITIVE PAPER COATINGS

[75] Inventors: Tomoo Shibata, Amherst; John Semler, Buffalo; George Gaesser, North Tonawanda, all of N.Y.

[73] Assignee: Graphic Controls Corporation, Buffalo, N.Y.

[21] Appl. No.: 478,259

[22] Filed: Feb. 9, 1990

[51] Int. Cl.[5] ..... B41M 5/30

[52] U.S. Cl. ..... 503/209; 106/21; 503/220; 503/221; 503/225

[58] Field of Search ..... 427/150–152; 503/208, 209, 221, 225, 220; 106/21

[56] References Cited

U.S. PATENT DOCUMENTS

| | | | |
|---|---|---|---|
| 4,278,747 | 7/1981 | Murayama et al. | 430/82 |
| 4,367,273 | 1/1983 | Murayama et al. | 430/56 |
| 4,396,696 | 8/1983 | Nagasaka et al. | 430/78 |
| 4,416,939 | 11/1983 | Igarashi et al. | 428/323 |
| 4,466,007 | 8/1984 | Nakamura et al. | 503/200 |
| 4,473,831 | 9/1984 | Watanabe | 503/209 |
| 4,485,160 | 11/1984 | Suzuki et al. | 430/59 |
| 4,531,140 | 7/1985 | Suzuki et al. | 503/209 |
| 4,567,019 | 1/1986 | Lawton | 428/913 |
| 4,600,674 | 7/1986 | Emoto et al. | 430/72 |
| 4,618,555 | 10/1986 | Suzuki et al. | 430/78 |
| 4,628,335 | 12/1986 | Igasashi et al. | 503/208 |
| 4,631,242 | 12/1986 | Emoto et al. | 430/58 |
| 4,672,401 | 6/1987 | Yamada et al. | 503/208 |
| 4,687,721 | 8/1987 | Emoto et al. | 430/58 |
| 4,707,463 | 11/1987 | Ikeda et al. | 503/209 |
| 4,734,348 | 3/1988 | Suzuki et al. | 430/96 |
| 4,742,042 | 5/1988 | Hiraishi et al. | 503/201 |
| 4,791,194 | 12/1988 | Suzuki et al. | 534/752 |

FOREIGN PATENT DOCUMENTS

| | | | |
|---|---|---|---|
| 0349194 | 6/1989 | European Pat. Off. | 503/221 |

OTHER PUBLICATIONS

Chemical Abstracts, vol. 109, No. 11, Abstract #201615x.

*Primary Examiner*—Bruce H. Hess
*Attorney, Agent, or Firm*—Ratner & Prestia

[57] ABSTRACT

A heat sensitive coating has a colorless or light colored leuco dye precursor, preferably having a five-membered spirol lactone ring at one end of the molecule, and a tertiary amino group at another end of the molecule, and a developer. Sensitizers which increase the heat sensitivity of these dye precursors, and compositions of sensitized dye/developer systems are disclosed. The sensitizers are γ-substituted lactones, 3-naphthylmethylidenephthalide, and derivatives of benzalphthalide.

23 Claims, 1 Drawing Sheet

SENSITIZER FOR HEAT SENSITIVE PAPER COATINGS

BACKGROUND OF THE INVENTION

1. Field of the Invention

The present invention relates to sensitizers for heat sensitive leuco dye-based recording papers.

2. Description of Related Art

Direct thermal printing of documents offers numerous advantages over other printing methods due to its simplicity and quietness and has been widely used for chart recorders and telecopy machines. As with any hardcopy generation method, it is desirable that thermal printing be as fast as possible. To increase the speed of thermal printing, shorter dwell times between the thermal printing head and the heat sensitive paper must be achieved. To reduce print head dwell time, either more energy must be delivered to the paper, and thus to the print head, in a given time, or the sensitivity of the paper must be increased. Input energy to the thermal head is limited since the energy shock caused by a short heat/cool cycle deteriorates the life of a thermal head very quickly. Therefore the sensitivity of the heat sensitive recording paper must be increased.

Various methods have been attempted to increase the heat sensitivity of the paper. Calendering and precoating the paper before application of heat sensitive compounds are two techniques used for this purpose. The calendering smooths the surface of the heat sensitive paper for better contact with the thermal printing head, and the precoating inhibits the heat sensitive compounds from soaking into the paper. Although these methods have increased the sensitivity of the paper, even higher sensitivity is desired.

Recent efforts have focused on increasing the sensitivity of the heat sensitive paper by increasing the sensitivity of the dye precursor and developer combinations used in the heat sensitive compounds on the paper. Dye sensitization has been attempted previously, especially in the field of photosensitive diazo dyes. Diazo dyes are based on the diazo group (—N=N—). Photosensitizers for diazo dyes work by forming a charge transfer complex with the diazo dye precursor.

The dyes employed in this invention are not diazo dyes. Specifically, the dyes of interest here are leuco dyes having a five-membered spirol lactone ring at one end of the molecule, and a tertiary amino group at another end of the molecule to facilitate a lactone ring opening. Leuco dye precursors are colorless or light colored. In such a system, the heat sensitive coating comprises a dye precursor and a developer. The image is formed by the chemical transformation of the dye precursor into a dye by reaction with the developer. This transformation results in a visible product. The dye itself produces the visible image. Heating the coating allows the developer and dye precursor to react and form color.

Low melting waxes and fatty amides have been used to increase the sensitivity of thermal paper by lowering the melting point of the heat sensitive coating. Such waxes and amides can cause background instability and residue build-up on the thermal head and are therefore generally not preferred.

A number of sensitizers have been found to improve heat sensitivity of the paper without the drawbacks of the waxes and fatty amides. Some of those compounds are aromatic ethers, aromatic esters, or biphenyl derivatives, including 2-benzyloxynapthalene, 1,4-diphenoxybutanes, 4-benzylbiphenyl, and o-acetoacetotoluidide. Sensitizers facilitate the dye forming process. The thermal sensitizers are believed to function by lowering the eutectic melting point of the dye precursor/developer system, or by acting as a solvent in which a dye precursor and developer dissolve below their melting point.

SUMMARY OF THE INVENTION

Several sensitizers for thermally sensitive compounds and paper have now been developed. A heat sensitive coating has a colorless or light colored leuco dye precursor, preferably having a five-membered spirol lactone ring at one end of the molecule, and a tertiary amino group at another end of the molecule, and a developer. More preferably, these dyes have the general form:

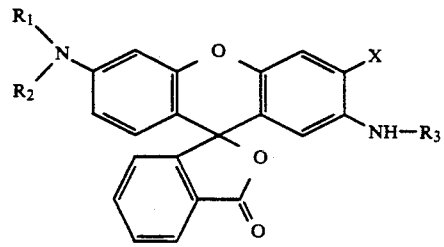

where $R_1$ and $R_2$ are one of a $C_1$ to $C_{10}$ alkyl or cycloalkyl group, $R_3$ is an aryl group, and X is a $C_1$ to $C_{10}$ alkyl group or a halogen.

The coating further comprises a sensitizer selected from the following group:

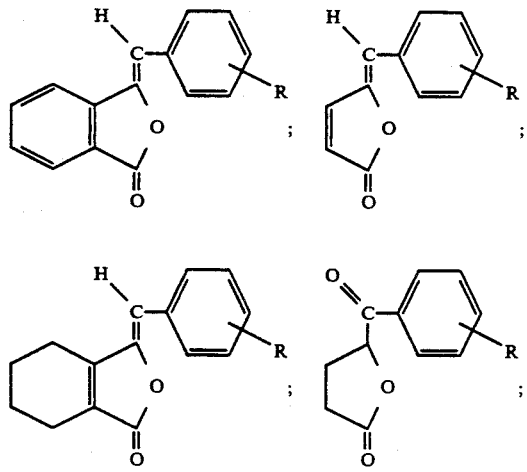

where R is selected from the group consisting of a $C_1$–$C_4$ alkane, a $C_1$–$C_4$ alkylhalide, a halogen, and hydrogen; and

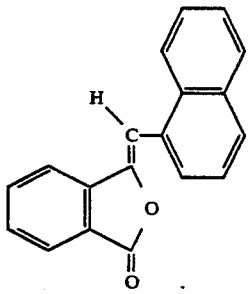

No useful lower or upper concentration limits has been established for these sensitizers. They have been tested at concentrations as low as 10% and as high as 300% of the amount of dye in the heat sensitive composition, with good results.

DETAILED DESCRIPTION OF THE INVENTION

Figure 1:
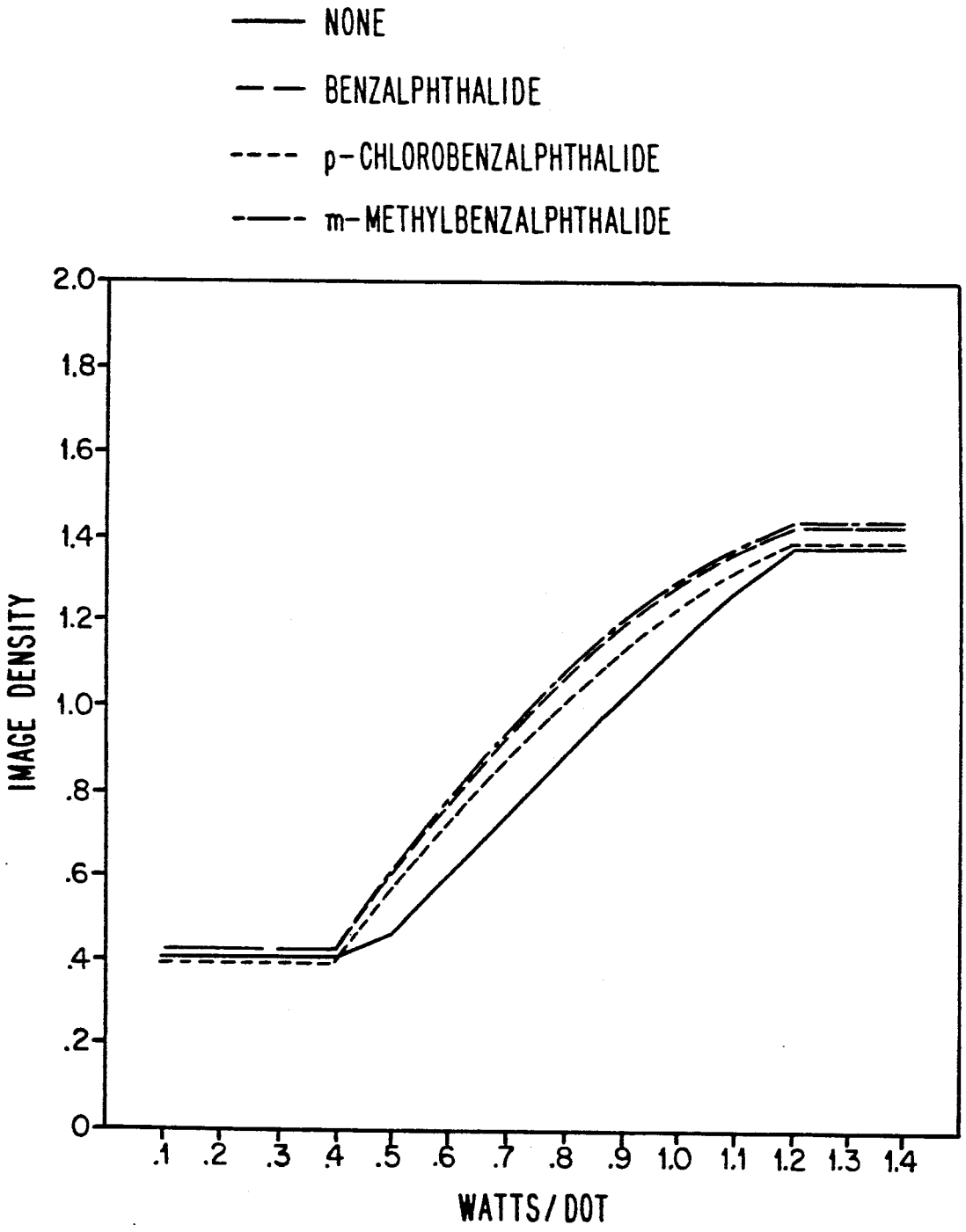
FIG. 1 is a graph of image density vs. printing energy for heat sensitive paper utilizing the coating of the present invention.

Derivatives of benzalphthalide, naphthylphthalide and γ-substituted lactones are effective sensitizers in thermal dye/developer systems. The dyes with which these sensitizers are useful are leuco dyes which have a colorless or light colored dye precursor. These dye precursors generally have a fivemembered spirol lactone ring at one end of the dye molecule, and a ternary amino group at another end of the molecule to facilitate a lactone ring opening. Specifically preferred are dye precursors which are xanthane compounds of the general formula:

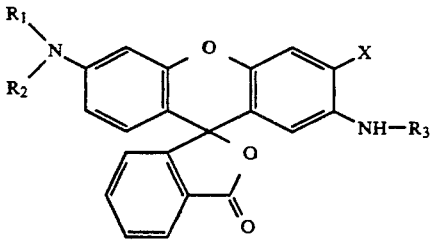

where $R_1$ and $R_2$ are one of a $C_1$ to $C_{10}$ alkyl or cycloalkyl group, $R_3$ is an aryl group, and X is a $C_1$ to $C_{10}$ alkyl group or a halogen.

SENSITIZERS

The various sensitizers were synthesized, and tested with various dyes and developers for their sensitizing properties, as well as their effect on image retention. The results of these tests show that the variety of sensitized dye precursors were more responsive to heat than the unsensitized precursors, and the dyes had good image retention.

The benzalphthalide-based thermal sensitizers are compounds having the following general structures:

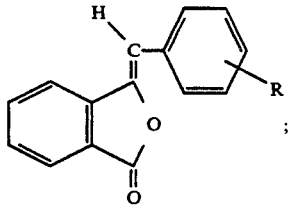

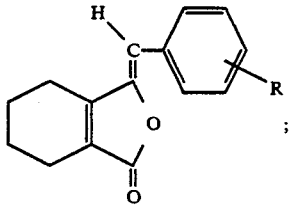

where R is one of a $C_1$–$C_4$ alkane, a halogen, a $C_1$–$C_4$ alkylhalide, or hydrogen. Another thermal imaging sensitizer is 3-naphthylmethylidenephthalide which has the following structure:

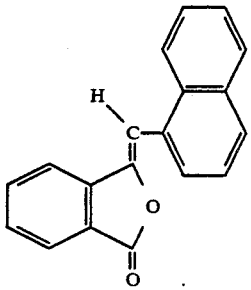

The γ-substituted lactone thermal imaging sensitizers are compounds having the following general structures:

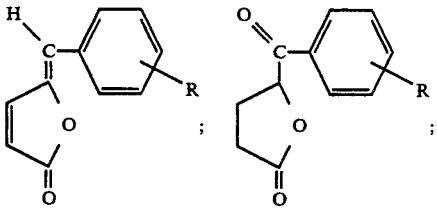

where R is one of a $C_1$–$C_4$ alkane, a halogen, a $C_1$–$C_4$ alkylhalide, or hydrogen.

Preparation of Sensitizers

Preparation of Benzalphthalide

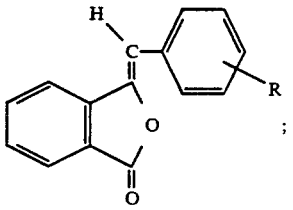

benzalphthalide

Benzalphthalide (above) was synthesized according to the following method: a mixture of 50 g (0.335 mol) of phthalic anhydride, 55g (0.4 mol) of phenyl acetic acid and 1.3g of sodium acetate was heated to 270° C. in a round-bottomed flask fitted with a condenser and a receiving flask. Heating was continued until water ceased to evolve from the reaction mixture (approximately three hours). The resulting solid was recrystallized from ethanol to provide 67g (89% yield) of the benzalphthalide. The melting point of benzalphthalide is 99–102° C. PMR($CDCl_3$, 60 MHz): 5.95 PPM (s, 1H), 6.11–7.59 PPM (m, 9H), IR($CM^{-1}$): 1765, 1345, 1265, 1070, 960, 750, 675.

Preparation of p-Fluorobenzalphthalide

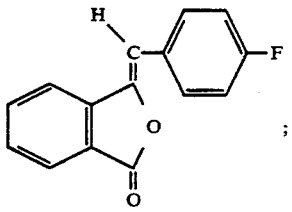

p-fluorobenzalphthalide p-Fluorobenzalphthalide (above) was synthesized using the same method as described for benzalphthalide except that p-fluorophenylacetic acid was used in place of phenyl acetic acid. The yield was 90%. The melting point of p-fluorobenzalphthalide is 145–145.2° C. PMR($CDCl_3$, 60 MHz): 6.05 (s, 1H), 6.48–7.68 PPM (m, 8H). IR($CM^{-1}$): 1780, 1660, 1590, 1495, 1460, 1350, 1265, 1220, 1150, 1070, 960, 850, 815, 740, 670.

Preparation of p-Chlorobenzalphthalide

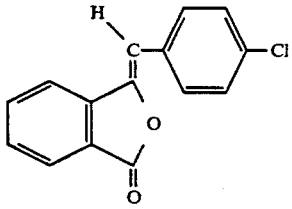

p-chlorobenzalphthalide p-Chlorobenzalphthalide (above) was synthesized in the same way as described for benzalphthalide except that p-chlorophenylacetic acid was used in place of phenyl acetic acid. The yield was 61%. The melting point of p-chlorobenzalphthalide is 154–155° C. PMR($CDCl_3$, 60 MHz): 5.90 (s, 1H), 6.26–7.42 PPM (m, 8H). IR($CM^{-1}$): 1785, 1480, 1400, 1350, 1260, 1190, 1070, 960, 840, 745, 670.

Preparation of p-Bromobenzalphthalide

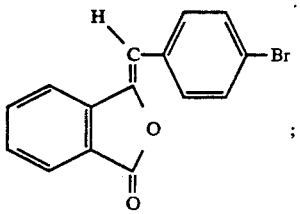

p-bromobenzalphthalide p-Bromobenzalphthalide (above) was synthesized in the same way described for benzalphthalide except that p-bromophenylacetic acid was used in place of phenyl acetic acid. The yield was 77%. The melting point of p-bromobenzalphthalide is 175–175° C. PMR($CDCl_3$, 60 MHz): 6.01 (s, 1H), 7.00–7.70 PPM (m, 8H). IR($CM^{-1}$): 1780, 1460, 1395, 1345, 1260, 1190, 1060, 960, 840, 740.

Preparation of m-Methylbenzalphthalide

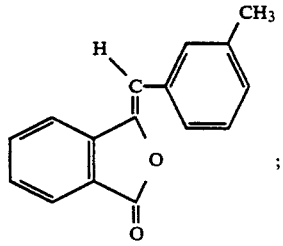

m-methylbenzalphthalide m-Methylbenzalphthalide (above) was synthesized in the same way as described for benzalphthalide except that m-tolylacetic acid was used in place of phenyl acetic acid. The yield was 71%. The melting point of m-methylbenzalphthalide is 155–156° C. PMR($CDCl_3$, 60 MHz): 2.28 PPM (s, 3H), 6.16 PPM (s, 1H), 6.59–7.45 PPM (m, 8H). IR($CM^{-1}$): 1758, 1460, 1350, 1770, 1150, 1075, 965, 855, 750, 675.

Preparation of o-Methylbenzalphthalide

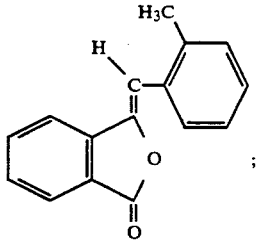

o-methylbenzalphthalide o-Methylbenzalphthalide (above) was synthesized in the same way as described for benzalphthalide except that o-tolylacetic acid was used in place of phenyl acetic acid. The yield was 73%. The melting point of o-methylbenzalphthalide is 130–131° C. PMR($CDCl_3$, 60MHz): 2.28 PPM (s, 3H), 6.16 PPM (s, 1H), 6.59–7.45 PPM (m, 8H). IR($CM^{-1}$): 1755, 1450, 1360, 1325, 1260, 1075, 965, 740.

Preparation of γ-Benzoyl-γ-butyrolactone and (Z)-5-benzalfuran-2(5H)-one

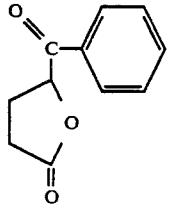

γ-benzolyl-γ-butyrolactone

-continued

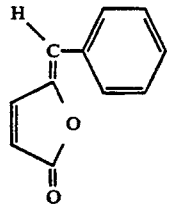

(Z)-5-benzalfuran-2(5H)-one

γ-Benzoyl-γ-butyrolactone and (Z)-5benzalfuran-2(5H)-one (above) were synthesized according to the following method: a solution of $Br_2$ (12 g) in 90 ml of dioxane-ether (v/v 5:2) was added to a stirred solution of 4 benzoylbuteric acid (11.5 g) in 400 ml of dioxane-ether (v/v 5:2) at 30–35° C. and the mixture was stirred for 4.5 hours. The mixture was extracted with ethylacetate (AcOEt) several times and the ethylacetate extracts were washed with water. The mixture was then washed with an aqueous sodium carboxylate ($NaHCO_3$) solution, then with a saturated sodium chloride solution, and dried. Evaporation of ethylacetate and recrystallization from benzene-hexane solvent yielded 8 grams (74%) of γ-benzoyl-γ-butyrolactone. PMR($CDCl_3$, 60 MHz): 2.6 (4H, m), 5.85(1H, m). Eight grams of this lactone and 8 grams of p-toluenesulfonic acid in 400 ml of acetic anhydride ($Ac_2O$) was refluxed for 8 hours and evaporated in vacuo leaving a residue which was taken up in chloroform.

The chloroform extract was washed with an aqueous sodium carboxylate solution and a saturated sodium chloride solution, dried and evaporated. The residue was sublimed at 120° C under vacuum at 16 mmHg. Recrystallization from hexane produced 6.1 grams (80% from the intermediate) of (Z)-5-benzalfuran-2(5H)-one. The melting point was 85–87° C. PMR($CCl_4$, 60MHz): 5.90(1H, s, vinyl Hc), 6.14(1H, d, J=5.5, vinyl Ha), 7.41(1H, d, J=5.5, vinyl Hb).

Preparation of 3,4,5,6 tetrahydrobenzalphthalide

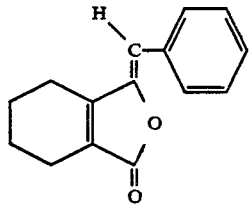

3,4,5,6-tetrahydrobenzalphthalide 3,4,5,6-Tetrahydrobenzalphthalide (above) was synthesized in the same way described for benzalphthalide, except that 3,4,5,6-tetrahydrophthalic anhydride was used in place of phthalic anhydride. The yield was 48%. The melting point of 3,4,5,6-tetrahydrobenzalphthalide is 117–117.5° C. PMR($CDCl_3$, 60 MHz): 1.49–1.87(4H, m), 1.97–2.54(4H, m), 5.54(1H, s), 6.82–7.53(5H, s).

Preparation of 3-Naphthylmethylidenephthalide

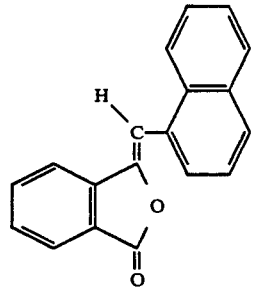

3-naphthylmethylidenephthalide

3-Naphthylmethylidenephthalide (above) was synthesized in the same way described for benzalphthalide, except that 1-naphthylacetic acid was used in place of phenyl acetic acid. The yield was 66%. The melting point of 3-naphthylmethylidenephthalide is 181–183° C. PMR($CDCl_3$, 60 MHz): 6.80(1H, s), 6.94–8.12(11H, m). IR($cm^{-1}$): 3500, 3040, 2910, 2840, 2040, 1930, 1750, 1645, 1600, 1585, 1505, 1470, 1370, 1335, 1320, 1300, 1270, 1245, 1150, 1080, 1030, 1015, 960, 845, 740, 670.

Preparation of Coating Solutions

Heat sensitive paper is produced by coating paper with heat sensitive dispersions. The dispersions contain a dye precursor and a developer. The sensitizers are utilized by incorporating them into the paper coating dispersions. The heat sensitive paper coating consists of two dispersions, A and B. Dispersion A is a developer system, to which the sensitizer is added. Dispersion B is a dye precursor system. The two dispersions are applied to prepared paper and the coated paper is dried, resulting in a heat sensitive, coated paper. The dispersions are preferably applied in such proportions to produce coated paper with a sensitizer:dye ratio between 0.5 and 3.0, and a developer:dye ratio between 1.0 and 3.0. The proportions of the coating components (dispersions A and B) were calculated to provide such final sensitizer:-dye and developer:dye ratios.

Dispersion A is a developer/sensitizer system and its composition is as follows:

| COMPONENT | PARTS |
|---|---|
| developer | 6.8 |
| sensitizer | 3.2 |
| 50% aqueous zinc stearate | 2.1 |
| 2,2-methylene-bis-(4-methyl-6-t-butylphenol) | 1.9 |
| calcium carbonate | 9.9 |
| 10% aqueous polyvinyl alcohol | 14.2 |
| 10% aqueous starch | 42.9 |
| defoamer (Nalco OSS-271, available from Nalco Chemical Co, Naperville, IL) | 0.8 |
| water | 18.2 |

To evaluate the influence of developers, the following developers were used in dispersion A in the various examples which follow: benzyl-p-hydroxybenzoate (PHBB) (common name benzalparaben), 2,2-bis(p-hydroxyphenyl)propane (BPA), and bis-(3-allyl-4-hydroxyphenyl)sulfone (TG-SA). In each case, the components were dispersed for 30 minutes in an attritor.

Dispersion B is a dye dispersion and its chemical composition is as follows:

| COMPONENT | PARTS |
|---|---|
| dye | 25.0 |
| 10% aqueous polyvinyl alcohol | 30.0 |
| surfactant (Colloids 211, available from Colloids, Inc., Newark, NJ) | 0.2 |
| water | 44.8 |

To evaluate the influence of dyes, the following dyes were tested in dispersion B in the various examples which follow: 3-diethylamino-6-methyl-7-anilinofluoran (N-102), Copikem-34 (available from Hilton Davis Co., Cincinnati, Ohio), 3-N-methyl-N-cyclohexylamino-6-methyl-7-anilinofluoran (IBR) and 3-dibutylamino-6-methyl-7-anilinofluoran (TH-108).

Preparation of Thermal Papers

A coating solution was prepared by mixing 92 parts by weight of dispersion A and 8 parts by weight of dispersion B. The coating solution was applied at 28 lb/3000 $ft^2$ base paper, to give a coated amount of 8 $g/m^2$ on a solid basis. The paper was then dried and treated three times with a calender at 330 pli (pounds per linear inch). The final composition of the thermal paper on a dry basis was:

| COMPONENT | PARTS |
|---|---|
| Dye | 7.0 |
| Developer | 21.0 |
| Sensitizer | 10.0 |
| Zinc Stearate | 6.4 |
| 2,2'-methylene-bis-(4-methyl-6-t-butylphenol) | 6.0 |
| Calcium Carbonate | 30.8 |
| Polyvinyl alcohol | 4.4 |
| Starch | 13.3 |
| Surfactant/Defoamer | 1.1 |

which was within the desired range.

To compare the performance of the compounds of the present invention with other sensitizers, o-acetoacetotoluidide was used in the heat sensitive composition. o-Acetoacetotoluidide is a known thermal sensitizer. Heat sensitive paper using this sensitizer was prepared for use as a comparative example. Further, an undercoated paper with a sensitized dye/developer system was also prepared as a comparative example. A latex undercoating was applied to the base paper prior to the application of the dye/developer coating above (with benzalphthalide as a sensitizer). The paper was then dried and printed.

Results

The papers were printed using a Hobart Thermal Printer Model 18VP. Resulting image densities were measured with a SpeedMaster Solid-State Color Densitometer. Optical densities shown are in ODUs (optical density units). Printing was made at from 0.5 to 1.4 watts per dot. The results are summarized in the following tables.

Table 1 shows the influence of benzalphthalide sensitizer on various dye/developer systems. Regardless of the dye used, the addition of benzalphthalide as a sensitizer resulted in a significant improvement in thermal sensitivity to lower print input energies.

TABLE 1

Influence of benzalphthalide sensitizer on various dye/developer systems

| | | | Input energy, Watts/dot | | | | | | | | | | |
|---|---|---|---|---|---|---|---|---|---|---|---|---|---|
| Dye | Developer | Sensitizer | 0.00 | 0.50 | 0.60 | 0.70 | 0.80 | 0.90 | 1.00 | 1.10 | 1.20 | 1.30 | 1.40 |
| N-102 | PHBB | benzalphthalide | 0.04 | 0.64 | 0.92 | 1.18 | 1.27 | 1.31 | 1.36 | 1.36 | 1.38 | 1.38 | 1.38 |
| N-102 | PHBB | none | 0.04 | 0.30 | 0.56 | 0.71 | 1.04 | 1.16 | 1.27 | 1.36 | 1.40 | 1.42 | 1.48 |
| N-102 | BPA | benzalphthalide | 0.05 | 0.19 | 0.40 | 0.53 | 0.81 | 1.04 | 1.09 | 1.22 | 1.22 | 1.32 | 1.33 |
| N-102 | BPA | none | 0.05 | 0.07 | 0.14 | 0.30 | 0.36 | 0.69 | 0.78 | 0.97 | 1.09 | 1.13 | 1.20 |
| N-102 | TG-SA | benzalphthalide | 0.11 | 0.30 | 0.49 | 0.73 | 1.01 | 1.13 | 1.23 | 1.31 | 1.34 | 1.38 | 1.40 |
| N-102 | TG-SA | none | 0.05 | 0.19 | 0.26 | 0.41 | 0.58 | 0.79 | 0.93 | 1.07 | 1.24 | 1.26 | 1.30 |
| C-34 | PHBB | benzalphthalide | 0.03 | 0.59 | 0.99 | 1.18 | 1.25 | 1.35 | 1.35 | 1.38 | 1.37 | 1.37 | 1.38 |
| C-34 | PHBB | none | 0.02 | 0.31 | 0.62 | 1.06 | 1.26 | 1.36 | 1.38 | 1.39 | 1.40 | 1.41 | 1.42 |
| C-34 | BPA | benzalphthalide | 0.02 | 0.16 | 0.39 | 0.55 | 0.78 | 1.04 | 1.12 | 1.18 | 1.17 | 1.26 | 1.24 |
| C-34 | BPA | none | 0.02 | 0.04 | 0.09 | 0.22 | 0.50 | 0.71 | 0.82 | 1.07 | 1.13 | 1.17 | 1.23 |
| C-34 | TG-SA | benzalphthalide | 0.06 | 0.25 | 0.51 | 0.81 | 1.02 | 1.21 | 1.30 | 1.37 | 1.38 | 1.43 | 1.40 |
| C-34 | TG-SA | none | 0.04 | 0.09 | 0.17 | 0.38 | 0.62 | 0.86 | 1.03 | 1.20 | 1.31 | 1.37 | 1.36 |
| IB-R | PHBB | benzalphthalide | 0.03 | 0.49 | 0.76 | 0.96 | 1.19 | 1.27 | 1.31 | 1.33 | 1.35 | 1.36 | 1.38 |
| IB-R | PHBB | none | 0.02 | 0.21 | 0.46 | 0.82 | 1.05 | 1.16 | 1.28 | 1.34 | 1.38 | 1.40 | 1.41 |
| IB-R | BPA | benzalphthalide | 0.02 | 0.12 | 0.29 | 0.38 | 0.67 | 0.91 | 1.02 | 1.14 | 1.18 | 1.23 | 1.27 |
| IB-R | BPA | none | 0.02 | 0.03 | 0.09 | 0.20 | 0.41 | 0.58 | 0.87 | 1.01 | 1.08 | 1.18 | 1.26 |
| IB-R | TG-SA | benzalphthalide | 0.11 | 0.21 | 0.34 | 0.48 | 0.73 | 0.92 | 1.09 | 1.27 | 1.29 | 1.34 | 1.38 |
| IB-R | TG-SA | none | 0.04 | 0.09 | 0.17 | 0.29 | 0.43 | 0.57 | 0.80 | 0.99 | 1.04 | 1.22 | 1.27 |
| TH-108 | PHBB | benzalphthalide | 0.02 | 0.45 | 0.84 | 1.09 | 1.20 | 1.27 | 1.31 | 1.33 | 1.34 | 1.37 | 1.37 |
| TH-108 | PHBB | none | 0.01 | 0.28 | 0.57 | 0.79 | 1.16 | 1.26 | 1.33 | 1.39 | 1.39 | 1.39 | 1.37 |
| TH-108 | BPA | benzalphthalide | 0.02 | 0.15 | 0.34 | 0.63 | 0.72 | 0.95 | 0.99 | 1.10 | 1.18 | 1.23 | 1.24 |
| TH-108 | BPA | none | 0.02 | 0.05 | 0.11 | 0.25 | 0.46 | 0.61 | 0.93 | 1.03 | 1.20 | 1.20 | 1.22 |
| TH-108 | TG-SA | benzalphthalide | 0.07 | 0.24 | 0.43 | 0.68 | 0.93 | 1.05 | 1.25 | 1.32 | 1.35 | 1.37 | 1.38 |
| TH-108 | TG-SA | none | 0.02 | 0.07 | 0.18 | 0.31 | 0.55 | 0.74 | 0.92 | 1.07 | 1.14 | 1.35 | 1.29 |

Table 2 shows the effect of substituents on a benzalphthalide sensitizer in a 3-diethylamino-6-methyl-7-anilinofluoran (N-102) benzyl-p-hydroxybenzoate (PHBB) dye/developer system. The p-fluoro, p-chloro, p-bromo, o-$CH_3$, and m-$CH_3$ derivatives of benzalphthalide. Each derivative performed well as a sensitizer in a 3-diethylamino-6-methyl-7-anilinofluoran (N-102) benzyl-p-hydroxybenzoate (PHBB) dye/developer system.

TABLE 2

Effect of substituents on a benzalphthalide sensitizer in an N-102/PHBB dye/developer system

| | | | Input energy, Watts/dot | | | | | | | | | | |
|---|---|---|---|---|---|---|---|---|---|---|---|---|---|
| Dye | Developer | Sensitizer | 0.00 | 0.50 | 0.60 | 0.70 | 0.80 | 0.90 | 1.00 | 1.10 | 1.20 | 1.30 | 1.40 |
| N-102 | PHBB | benzalphthalide (BP) | 0.04 | 0.64 | 0.92 | 1.18 | 1.27 | 1.31 | 1.36 | 1.36 | 1.38 | 1.38 | 1.38 |

TABLE 2-continued

Effect of substituents on a benzalphthalide sensitizer in an N-102/PHBB dye/developer system

| Dye | Developer | Sensitizer | Input energy, Watts/dot 0.00 | 0.50 | 0.60 | 0.70 | 0.80 | 0.90 | 1.00 | 1.10 | 1.20 | 1.30 | 1.40 |
|---|---|---|---|---|---|---|---|---|---|---|---|---|---|
| N-102 | PHBB | p-F-benzalphthalide | 0.03 | 0.36 | .0.71 | 0.99 | 1.19 | 1.25 | 1.29 | 1.33 | 1.31 | 1.33 | 1.32 |
| N-102 | PHBB | p-Cl-benzalphthalide | 0.04 | 0.39 | 0.72 | 0.99 | 1.20 | 1.25 | 1.28 | 1.39 | 1.36 | 1.40 | 1.41 |
| N-102 | PHBB | p-Br-benzalphthalide | 0.03 | 0.42 | 0.64 | 1.02 | 1.12 | 1.26 | 1.29 | 1.28 | 1.27 | 1.33 | 1.35 |
| N-102 | PHBB | m-methyl-BP | 0.03 | 0.43 | 0.81 | 1.07 | 1.30 | 1.32 | 1.34 | 1.40 | 1.43 | 1.43 | 1.44 |
| N-102 | PHBB | o-methyl-BP | 0.03 | 0.50 | 0.80 | 1.01 | 1.21 | 1.33 | 1.35 | 1.38 | 1.39 | 1.37 | 1.44 |

Table 3 shows a comparison among several of the different sensitizers disclosed herein, the undercoated benzalphthalide-sensitized paper, and plain (unsensitized) thermal paper in a 3-diethylamino-6-methyl-7-anilinofluoran (N-102) benzyl-p-hydroxybenzoate (PHBB) dye/developer system. The results in Table 3 show that sensitizer/dye/developer systems produced higher density images at low energy than systems without sensitizers. The partially saturated forms of the base compounds, (Z)-5-benzalfuran-2(5H)-one and benzalphthalide, performed well as sensitizers, as did the base compounds themselves. The sensitizers of the present invention also compared favorably to the previously known sensitizer, o-acetoacetotoluidide.

FIG. 1 is a graph of the image density obtained versus the input energy in watts/dot in a composition using 3-diethylamino-6-methyl-7-anilinofluoran (N-102) and benzyl-p-hydroxybenzoate (PHBB). The graph shows the effect of various sensitizers (and no sensitizers) with this dye/developer system. FIG. 1 shows that an increase in the thermal sensitivity of the dye/developer system occurs when the sensitizers of the present invention are added. The sensitized dye/developer systems showed a better heat sensitivity than the unsensitized dye/developer system, and a better or equivalent sensitivity than the comparative sample using o-acetoacetotoluidide.

TABLE 3

Performance of various sensitizers in an N-102/PHBB dye/developer system

| Dye | Developer | Sensitizer | Input energy, Watts/dot 0.00 | 0.50 | 0.60 | 0.70 | 0.80 | 0.90 | 1.00 | 1.10 | 1.20 | 1.30 | 1.40 |
|---|---|---|---|---|---|---|---|---|---|---|---|---|---|
| N-102 | PHBB | benzalphthalide | 0.04 | 0.64 | 0.92 | 1.18 | 1.27 | 1.31 | 1.36 | 1.36 | 1.38 | 1.38 | 1.38 |
| N-102 | PHBB | o-acetoacetotoluidide | 0.05 | 0.42 | 0.76 | 0.98 | 1.14 | 1.25 | 1.34 | 1.41 | 1.41 | 1.41 | 1.44 |
| N-102 | PHBB | none | 0.04 | 0.30 | 0.56 | 0.71 | 1.04 | 1.16 | 1.27 | 1.36 | 1.40 | 1.42 | 1.48 |
| N-102 | PHBB | MP-22 wax | | 0.37 | 0.78 | 1.00 | 1.23 | 1.35 | 1.40 | 1.46 | 1.45 | 1.50 | 1.52 |
| N-102 | PHBB | 3-naphthylmethylidenephthalide | 0.02 | 0.46 | 0.86 | 1.10 | 1.23 | 1.33 | 1.31 | 1.34 | 1.34 | 1.34 | 1.37 |
| N-102 | PHBB | (Z)-5-benzalfuran-2(5H)-one | 0.05 | 0.83 | 1.02 | 1.18 | 1.28 | 1.32 | 1.36 | 1.38 | 1.37 | 1.38 | 1.36 |
| N-102 | PHBB | Undercoated; with benzalphthalide | 0.04 | 0.75 | 1.04 | 1.16 | 1.28 | 1.32 | 1.36 | 1.38 | 1.40 | 1.40 | 1.43 |
| N-102 | PHBB | 3,4,5,6-tetrahydrobenzalphthalide | 0.02 | 0.41 | 0.79 | 0.99 | 1.21 | 1.26 | 1.31 | 1.33 | 1.34 | 1.32 | 1.39 |
| N-102 | PHBB | Γ-benzoyl-Γ-butyrolactone | 0.03 | 0.75 | 1.00 | 1.19 | 1.25 | 1.32 | 1.35 | 1.39 | 1.37 | 1.39 | 1.35 |

The image retention of the printed paper with a dye/developer system of N-102 and PHBB with various sensitizers disclosed herein was measured. Measurements were taken of the image and background darkness of paper maintained at 60° C. for 24 hours, and paper maintained at 40° C. and 80% relative humidity for 24 hours. The results of that test are summarized in Table 4. The results show that the sensitizers do not adversely affect the image retention of the printed images when subjected to humidity. As may be expected, the background of the thermally sensitive paper is more sensitive to heat and darkens more readily than the unsensitized paper. Some of the sensitizers tested were less susceptible to darkening with low levels of heat, such as the p-fluoro, p-bromo and m-methyl derivatives of benzalphthalide, and 3-naphthylmethylidenephthalide.

TABLE 4

Image stability in N-102/PHBB dye/developer systems with various sensitizers

| Dye | Developer | Sensitizer | Original Room temp., 0 Hr Background | Image | Heat 60° C., 24 hr. Background | Image (%) | Humidity (80%) 40° C., 24 hr. Background | Image (%) | White Crystal |
|---|---|---|---|---|---|---|---|---|---|
| N-102 | PHBB | benzalphthalide (BP) | 0.04 | 1.36 | 0.93 | 95 | 0.17 | 79 | good |
| N-102 | PHBB | p-F-benzalphthalide | 0.03 | 1.29 | 0.37 | 93 | 0.07 | 91 | good |
| N-102 | PHBB | p-Cl-benzalphthalide | 0.04 | 1.28 | 0.40 | 80 | 0.10 | 66 | good |
| N-102 | PHBB | p-Br-benzalphthalide | 0.03 | 1.29 | 0.25 | 81 | 0.01 | 61 | good |
| N-102 | PHBB | o-methyl-BP | 0.03 | 1.35 | 0.83 | 89 | 0.08 | 73 | good |
| N-102 | PHBB | m-methyl-BP | 0.03 | 1.34 | 0.35 | 90 | 0.08 | 96 | good |
| N-102 | PHBB | none | 0.05 | 1.27 | 0.20 | 77 | 0.08 | 63 | poor |
| N-102 | PHBB | MP-22 wax | | 1.40 | 0.27 | 86 | 0.08 | 70 | fair |
| N-102 | PHBB | 3-naphthylmethylidenephthalide | 0.02 | 1.31 | 0.26 | 92 | 0.02 | 98 | good |
| N-102 | PHBB | Γ-benzoyl-Γ-butyrolactone | 0.03 | 1.35 | 1.14 | 96 | 0.15 | 92 | good |
| N-102 | PHBB | (Z)-5-benzalfuran-2(5H)-one | 0.05 | 1.36 | 1.09 | 88 | 0.10 | 90 | good |
| N-102 | PHBB | Undercoated; with | 0.05 | 1.36 | 0.39 | 88 | 0.03 | 87 | good |

TABLE 4-continued

| Image stability in N-102/PHBB dye/developer systems with various sensitizers | | | | | | | | | |
|---|---|---|---|---|---|---|---|---|---|
| | | | Original Room temp., 0 Hr | | Heat 60° C., 24 hr. | | Humidity (80%) 40° C., 24 hr. | | White |
| Dye | Developer | Sensitizer | Background | Image | Background | Image (%) | Background | Image (%) | Crystal |
| N-102 | PHBB | benzalphthalide 3,4,5,6-tetrahydro- | 0.02 | 1.31 | 0.76 | 98 | 0.04 | 91 | good |
| N-102 | PHBB | benzalphthalide o-acetoacetotoluidide | 0.05 | 1.34 | 0.72 | 84 | 0.29 | 68 | good |

The effect of different sensitizer:dye ratios was tested. The dry weight coating composition of the heat sensitive coating was unchanged except for the amounts of sensitizer and calcium carbonate. The total weight of sensitizer and calcium carbonate together was constant. Therefore, as the amount of sensitizer was increased, the amount of calcium carbonate was decreased. The results shown in Table 5 show that the sensitizer is effective over a wide range of sensitizer:dye ratios.

Thus, Tables 1 thru 5, taken along with FIG. 1 show that benzalphthalide, (Z)-5-benzalfuran-2(5H)-one, 3-naphthylmethylidenephthalide, and their derivatives are effective sensitizers providing increased sensitivity and stability in common dye/developer systems.

It is understood that various other modifications will be apparent to, and can be readily made by, those skilled in the art without departing from the spirit and scope of this invention. Accordingly, it is not intended that the scope of the claims appended hereto be limited to the description as set forth herein, but rather that the claims be construed as encompassing all the features of patentable novelty that reside in the present invention including all features that would be treated as equivalents thereof by those skilled in the art to which this invention pertains.

Specifically, it will be apparent to one skilled in the art that all compounds disclosed herein are benzylidene or naphthylmethylidene γ-lactones, phthalides, or 3,4,5,6-tetrahydrophthalides optionally including low molecular weight substituents on the benzyl or naphthyl rings and optionally including a carbonyl group replacing the methylidene group of the benzyl or naphthyl moieties. One skilled in the art should therefore be able to develop other compounds of similar structure and properties which will perform as sensitizers in the same manner as those compounds disclosed and claimed herein, with little or no undue experimentation. Such compounds should not be considered as departures from the spirit and scope of this invention.

said heat sensitive composition further containing a sensitizing compound selected from the group consisting of:

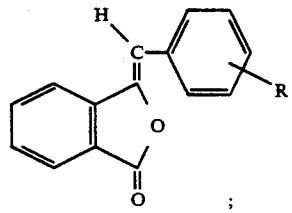

;

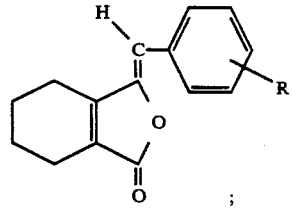

;

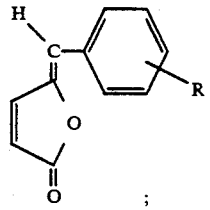

;

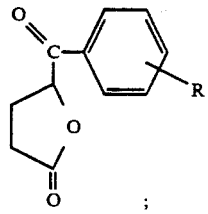

;

where R is selected from the group consisting of a $C_1$–$C_4$ alkane, a $C_1$–$C_4$ alkylhalide, a halogen, and hydrogen; and

TABLE 5

| Effect of sensitizer:dye ratio in a benzalphthalide/N-102/PHBB sensitizer/dye/developer system | | | | | | | | | | | | | |
|---|---|---|---|---|---|---|---|---|---|---|---|---|---|
| | | | Sensitizer:Dye | Input energy, Watts/dot | | | | | | | | | |
| Dye | Developer | Sensitizer | Ratio | 0.50 | 0.60 | 0.70 | 0.80 | 0.90 | 1.00 | 1.10 | 1.20 | 1.30 | 1.40 |
| N-102 | PHBB | benzalphthalide | 3:1 | 0.84 | 1.54 | 1.23 | 1.16 | 1.28 | 1.25 | 1.33 | 1.37 | 1.36 | 1.35 |
| N-102 | PHBB | benzalphthalide | 10:7 | 0.64 | 0.92 | 1.18 | 1.27 | 1.31 | 1.36 | 1.36 | 1.38 | 1.38 | 1.38 |
| N-102 | PHBB | benzalphthalide | 1:2 | 0.54 | 0.94 | 1.13 | 1.27 | 1.33 | 1.32 | 1.39 | 1.38 | 1.36 | 1.34 |
| N-102 | PHBB | benzalphthalide | 1:10 | 0.53 | 0.87 | 1.13 | 1.34 | 1.36 | 1.37 | 1.42 | 1.45 | 1.44 | 1.45 |

What is claimed is:

1. A heat sensitive composition comprising a colorless or light-colored dye precursor and a color developer capable of developing a color of said dye precursor with heating, said dye comprising a molecule having a five-membered spirol lactone ring on one portion, and a tertiary amino group on another portion of said molecule;

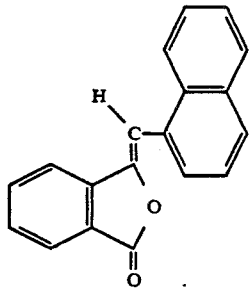

2. The composition of claim 1, wherein said dye is:

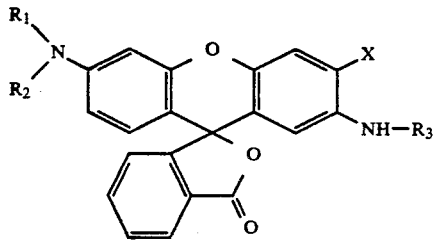

where $R_1$ and $R_2$ are one of a $C_1$ to $C_{10}$ aklyl or cycloalkyl group, $R_3$ is an aryl group, and X is a $C_1$ to $C_{10}$ alkyl group or a halogen.

3. The composition of claim 2, wherein said sensitizing compound is:

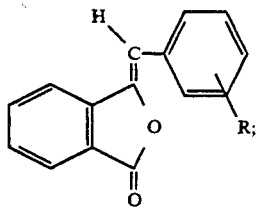

where R is selected from the group consisting of a $C_1$–$C_4$ alkane, a $C_1$–$C_4$ alkylhalide, a halogen, and hydrogen.

4. The composition of claim 3, wherein said sensitizing compound is benzalphthalide.

5. The composition of claim 3, wherein said sensitizing compound is p-fluorobenzalphthalide.

6. The composition of claim 3, wherein said sensitizing compound is p-chlorobenzalphthalide.

7. The composition of claim 3, wherein said sensitizing compound is p-bromobenzalphthalide.

8. The composition of claim 3, wherein said sensitizing compound is m-methylbenzalphthalide.

9. The composition of claim 3, wherein said sensitizing compound is o-methylbenzalphthalide.

10. The composition of claim 2, wherein said sensitizing compound is:

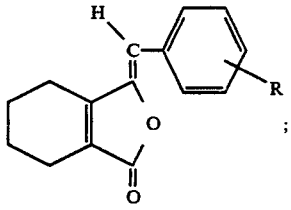

where R is selected from the group consisting of a $C_1$–$C_4$ alkane, a $C_1$–$C_4$ alkylhalide, a halogen, and hydrogen.

11. The composition of claim 10, wherein said sensitizing compound is 3,4,5,6- tetrahydrobenzalphthalide.

12. The composition of claim 2, wherein said sensitizing compound is:

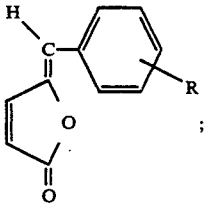

where R is selected from the group consisting of a $C_1$–$C_4$ alkane, a $C_1$–$C_4$ alkylhalide, a halogen, and hydrogen.

13. The composition of claim 12, wherein said sensitizing compound is (Z)-5-benzalfuran-2(5H)-one.

14. The composition of claim 2, wherein said sensitizing compound is:

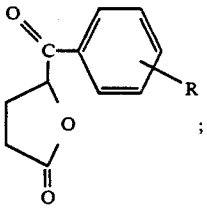

where R is selected from the group consisting of a $C_1$–$C_4$ alkane, a $C_1$–$C_4$ alkylhalide, a halogen, and hydrogen.

15. The composition of claim 14, wherein said sensitizing compound is γ-benzoyl-γ-butyrolactone.

16. The composition of claim 2, wherein said sensitizing compound is:

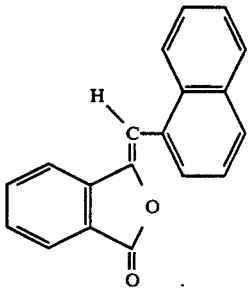

17. The composition of claim 1, wherein said sensitizing compound is:

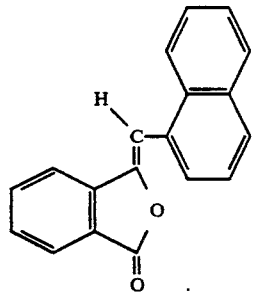

18. The composition of claim 1, wherein said sensitizing compound is m-methylbenzalphthalide.

19. The composition of claim 1, wherein said sensitizing compound is p-fluorobenzalphthalide.

20. The composition of claim 1, wherein said sensitizing compound is 3,4,5,6-tetrahydrobenzalphthalide.

21. The composition of claim 1, wherein said sensitizing compound is (Z)-5-benzalfuran-2(5H)-one.

22. The composition of claim 1, wherein said sensitizing compound is o-methylbenzalphthalide.

23. A heat sensitive recording material comprising the composition of claim 1 coated on a paper substrate.

* * * * *